United States Patent [19]

Ashok et al.

[11] Patent Number: 4,901,784

[45] Date of Patent: Feb. 20, 1990

[54] GAS ATOMIZER FOR SPRAY CASTING

[75] Inventors: Sankaranarayanan Ashok, Bethany; Harvey P. Cheskis, North Haven, both of Conn.

[73] Assignee: Olin Corporation, Cheshire, Conn.

[21] Appl. No.: 330,049

[22] Filed: Mar. 29, 1989

[51] Int. Cl.[4] ..... B22D 23/00

[52] U.S. Cl. ..... 164/429; 164/46; 118/302; 239/214

[58] Field of Search ..... 164/46, 479, 429; 427/422, 423; 118/302; 239/214, 499, 380

[56] References Cited

U.S. PATENT DOCUMENTS

| | | | |
|---|---|---|---|
| Re. 31,767 | 12/1984 | Brooks | 29/527.2 |
| 2,559,351 | 7/1951 | Drake et al. | 117/38 |
| 2,972,185 | 2/1961 | Brennan | 29/420.5 |
| 3,608,615 | 9/1971 | Conlon | 164/87 |
| 3,727,672 | 4/1973 | Grenfell . | |
| 3,742,585 | 7/1973 | Wentzell | 29/423 |
| 3,775,156 | 11/1973 | Singer | 117/65.2 |
| 3,826,301 | 7/1974 | Brooks | 164/46 |
| 3,909,921 | 10/1975 | Brooks | 29/527.2 |
| 4,512,384 | 4/1985 | Sendzimir | 164/46 |
| 4,546,815 | 10/1985 | Liebermann et al. | 164/463 |
| 4,582,117 | 4/1986 | Kushnick | 164/463 |
| 4,588,021 | 5/1986 | Bergeron et al. | 164/432 |
| 4,642,130 | 2/1987 | Hargreaves et al. | 65/60.1 |
| 4,721,154 | 1/1988 | Christ et al. | 164/452 |

FOREIGN PATENT DOCUMENTS

| | | |
|---|---|---|
| 0225732 | 6/1987 | European Pat. Off. . |
| 0225080 | 10/1987 | European Pat. Off. . |
| 1379261 | 2/1975 | United Kingdom . |
| 1472939 | 5/1977 | United Kingdom . |
| 2007129 | 5/1979 | United Kingdom . |
| 1548616 | 7/1979 | United Kingdom . |
| 1599392 | 9/1981 | United Kingdom . |
| 2172827 | 10/1986 | United Kingdom . |
| 2172900 | 10/1986 | United Kingdom . |

OTHER PUBLICATIONS

R. W. Evans et al., "The Osprey Preform Process", 1985, pp. 13–20, *Powder Metallurgy*, vol. 28, No. 1.

A. G. Leatham et al., "The Osprey Process for the Production of Spray-Deposited Roll, Disc, Tube and Billet Preforms", 1985, pp. 157–173, *Modern Developments in Powder Metallurgy*, vols. 15–17.

*Primary Examiner*—Kuang Y. Lin

[57] ABSTRACT

A gas-atomizing system for spray casting a spray of molten metal on a moving substrate in which the gas atomizing device is in the form of an annulus having a central opening therethrough through which the molten metal to be atomized flows. The annulus is provided with a plenum chamber which communicates with elongated openings on the bottom surface of the annulus. The manifold and outlets are so arranged that a divergent conical spray pattern is produced having a central axis inclined with respect to the vertical axis of the molten metal stream in a direction downstream of the moving substrate upon which the spray material is deposited.

26 Claims, 7 Drawing Sheets

GAS ATOMIZER FOR SPRAY CASTING

This application relates to copending U.S. application entitled "Asymmetrical Gas-Atomizing Device and Method for Reducing Porosity" by S. Ashok and T. Melillo, Ser. No. 322,434, filed Mar. 13, 1989.

The present invention generally relates to the spray-deposited production of a product on a moving substrate and, more particularly, is concerned with a device for gas-atomizing a molten metal stream to produce a spray of metal particles providing an improved distribution of temperature through the deposit cross-section and reduced bottom surface porosity in the deposit.

A commercial process for production of spray-deposited, shaped preforms in a wide range of alloys has been developed by Osprey Metals Ltd. of West Glamorgan, United Kingdom. The Osprey process, as it is generally known, is disclosed in detail in U.K. Pat. Nos. 1,379,261 and 1,472,939 and U.S. Pat. Nos. 3,826,301 and 3,909,921 and in publications entitled "The Osprey Preform Process"by R. W. Evans et al, *Powder Metallurgy*. Vol. 28, No. 1 (1985), pages 13–20 and "The Osprey Process for the Production of Spray-Deposited Roll, Disc, Tube and Billet Preforms" by A. G. Leatham et al, *Modern Developments in Powder Metallurgy*, Vols. 15–17 (1985), pages 157–173.

The Osprey process is essentially a rapid solidification technique for the direct conversion of liquid metal into shaped preforms by means of an integrated gas-atomizing/spray-depositing operation. In the Osprey process, a controlled stream of molten metal is poured into a gas-atomizing device where it is impacted by high-velocity jets of gas, usually nitrogen or argon. The resulting spray of metal particles is directed onto a "collector" where the hot particles re-coalesce to form a highly dense preform. The collector is fixed to a mechanism which is programmed to perform a sequence of movements within the spray, so that the desired preform shape can be generated. The preform can then be further processed, normally by hot-working, to form a semi-finished or finished product.

The Osprey process has also been proposed for producing strip or plate or spray-coated strip or plate, as disclosed in U.S. Pat. No. 3,775,156 and European Pat. Appln. No. 225,080. For producing these products, a substrate or collector, such as a flat substrate or an endless belt, is moved continuously through the spray to receive a deposit of uniform thickness across its width.

Heretofore, extensive porosity typically has been observed in a spray-deposited preform at the bottom thereof, its side in contact with the substrate or collector. This well known phenomenon, normally undesirable, is a particular problem in a thin gauge product, such as strip or tube, since the porous region may comprise a significant percentage of the product thickness. The porosity is thought to occur when the initial deposit layer is cooled too rapidly by the substrate, providing insufficient liquid to feed the inherent interstices between splatted droplets.

In the production of strip by the Osprey process, a gas-atomizing device is typically used. As disclosed in the above-cited U.S. Pat. No. 3,775,156 and European Pat. Appln. No. 225,080, the gas-atomizing device can be a symmetrical arrangement of jets or, alternatively, a single annular-shaped gas opening or annulus, surrounding the stream of molten metal. The gas-atomizing device converts the molten metal stream into a divergent spray cone of molten metal particles. The bottom surface porosity of the strip originates from the low mass density of particles in the leading region of the spray cone. Insufficient atomized particles are supplied in this region of the spray to maintain sufficient liquid to fill voids even when the center region of the spray is optimally producing high density interior structure in the deposit.

One approach of the prior art for eliminating these problems is preheating the substrate to minimize or reduce the rate of heat transfer from the initial deposit to the substrate so that the appropriate fraction liquid is always available to feed voids created during the spray deposition process. However, it is often difficult to effectively preheat a substrate in a commercial spray deposit system because of the cooling effects of the high velocity recirculating atomizing gas. Further, preheating a substrate increases the potential for the deposit sticking to the substrate. Therefore, a need exists for an alternative approach to eliminate the porosity problem particularly in thin gauge product produced by the above-described Osprey spray-deposition process.

The present invention provides a gas atomizing device designed to satisfy the aforementioned needs. The gas-atomizing device generates a spray cone of metal particles having an improved, more uniform, distribution of temperature through the deposit cross-section and reduced bottom surface porosity in the deposit.

The gas-atomizing device of the present invention produces a divergent spray cone whose central axis projects angularly away from the central axis of the vertical stream in a direction downstream of the moving substrate. The leading edge of the spray cone has less distance to travel to the substrate whereby hotter particles reach the substrate during the initial deposit. Additionally, as a result of gravity, more molten metal particles will segregate to the bottom, or leading region, of the spray cone. On the other hand, the prior art gas-atomizing device produces a divergent spray cone whose central axis projects coincident with the central axis of the vertical stream with more of the molten particles located centrally in the middle of the spray cone. Hence, the gas-atomizing device of the present invention provides a higher fraction of liquid in the initial deposits and closer to the substrate than the prior art gas-atomizing device, thus promoting improved temperature distribution through the cross-section of the deposit and minimal porosity in the bottom surface of the deposit.

These and other features and advantages of the present invention will become apparent to those skilled in the art upon a reading of the following detailed description when taken in conjunction with the drawings wherein there is shown and described illustrative embodiments of the invention.

In the course of the following detailed description, reference will be made to the attached drawings in which:

FIG. 9A is a horizontal sectional view of the embodiment shown in FIG. 9 taken along the lines 9A—9A of FIG. 9.

Figure 1:
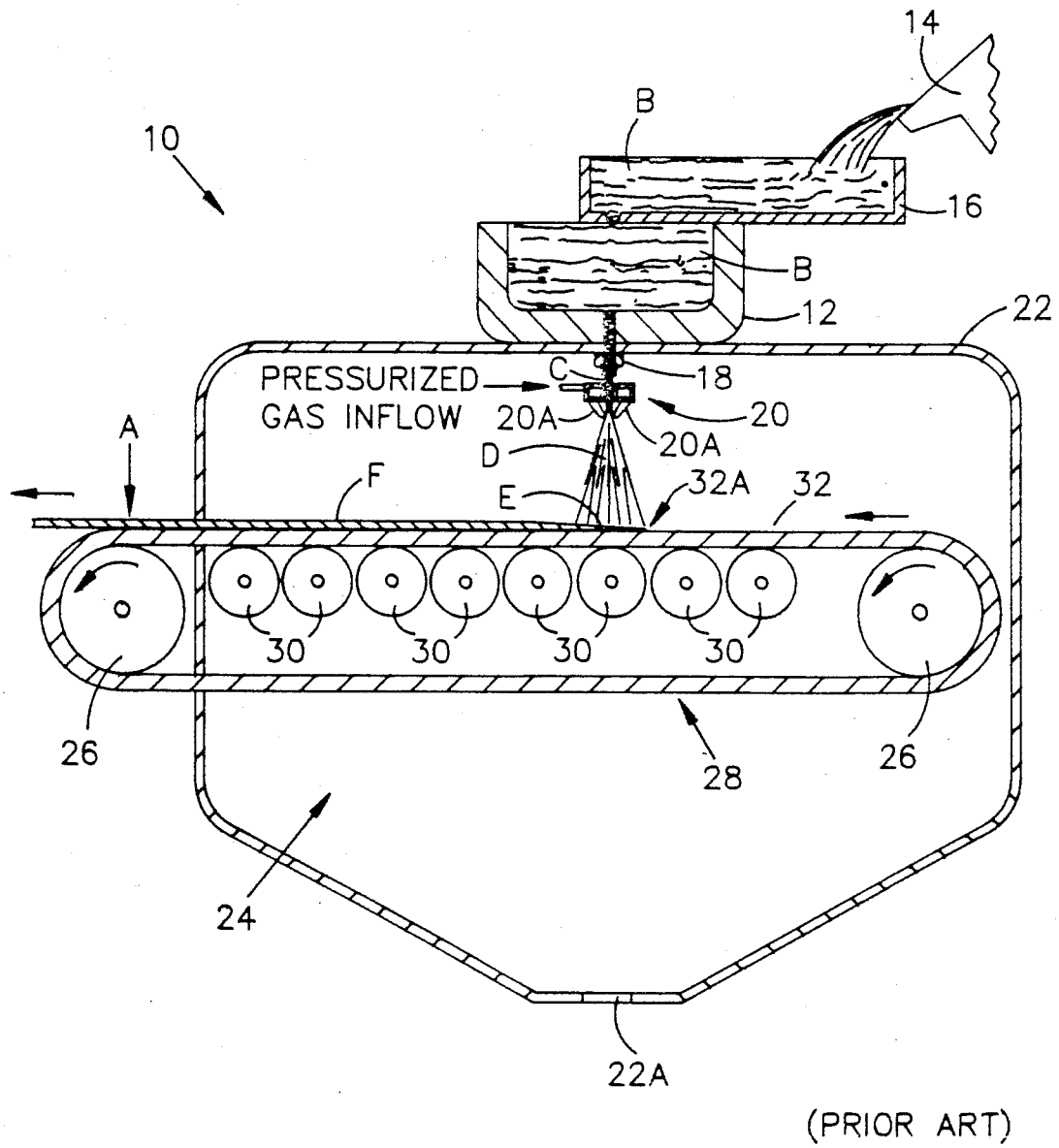
FIG. 1 is a schematic view, partly in section, of a prior art spray-deposition apparatus for producing a product on a moving substrate, such as in thin gauge strip form.

Referring now to the drawings, and particularly to FIG. 1, there is schematically illustrated a prior art spray-deposition apparatus, generally designated by the numeral 10, being adapted for continuous formation of products. An example of a product A is a thin gauge metal strip. One example of a suitable metal B is a copper alloy.

The spray-deposition apparatus 10 employs a tundish 12 in which the metal B is held in molten form. The tundish 12 receives the molten metal B from a tiltable melt furnace 14, via a transfer launder 16, and has a bottom nozzle 18 through which the molten metal B issues in a stream C downwardly from the tundish 12.

Also, a gas-atomizing device 20 employed by the apparatus 10 is positioned below the tundish bottom nozzle 18 within a spray chamber 22 of the apparatus 10. The atomizing device 20 is supplied with a gas, such as nitrogen, under pressure from any suitable source. The gas-atomizing device 20 which surrounds the molten metal stream C has a plurality of jets 20A symmetrically positioned about the stream C. The atomizing gas is thereby impacted or impinged on the stream from all sides and directions about the stream so as to convert the stream into a spray D of atomized molten metal particles, broadcasting downwardly from the atomizing device 20 in the form of a divergent conical pattern. If desired, the atomizing device 20 can be moved transversely in side-to-side fashion for more uniformly distributing the molten metal particles.

Further, a continuous substrate system 24 employed by the apparatus 10 extends into the spray chamber 22 in generally horizontal fashion and in spaced relation below the gas atomizing device 20. The substrate system 24 includes drive means in the form of a pair of spaced rolls 26, an endless substrate 28 in the form of a flexible belt entrained about and extending between the spaced rolls 26, and support means in the form of a series of rollers 30 which underlie and support an upper run 32 of the endless substrate 28. The substrate 28 is composed of a suitable material, such as stainless steel. An area 32A of the substrate upper run 32 directly underlies the divergent pattern of spray D for receiving thereon a deposit E of the atomized metal particles to form the metal strip product A.

The atomizing gas flowing from the atomizing device 20 is much cooler than the solidus temperature of the molten metal B in the stream C. Thus, the impingement of atomizing gas on the spray particles during flight and subsequently upon receipt on the substrate 28 extracts heat therefrom, resulting in lowering of the temperature of the metal deposit E below the solidus temperature of the metal B to form the solid strip F which is carried from the spray chamber 22 by the substrate 28 from which it is removed by a suitable mechanism (not shown). A fraction of the particles overspray the substrate 28, solidify and fall to the bottom of the spray chamber 22 where they along with the atomizing gas flow from the chamber via an exhaust port 22A.

The mass density and temperature distribution or profile of the gas-atomized metal of the prior art divergent pattern of spray D is bell-shaped across the pattern. Typically, as shown in the graph (A) of FIG. 3, the center region D(C) of the prior art divergent spray pattern D is of higher temperature (and also of higher mass density) than the periphery or outer fringe regions of the spray pattern D(L) and D(T). Because of the divergent configuration of the prior art spray pattern D and orientation of the substrate 28 relative thereto, the particles in the outer fringe regions thereof have to move through a greater distance to reach the horizontal substrate than particles in the center region thereof.

The porosity problem observed in the bottom surface of the strip F derives from the cooler, low mass density outer fringe regions of the prior art spray pattern D. In effect, this low mass density fringe region supplies insufficient atomized particles to maintain sufficient liquid to fill voids even when the center region of the spray pattern D is optimized and is producing high density interior structure in the deposit E.

Figure 3:
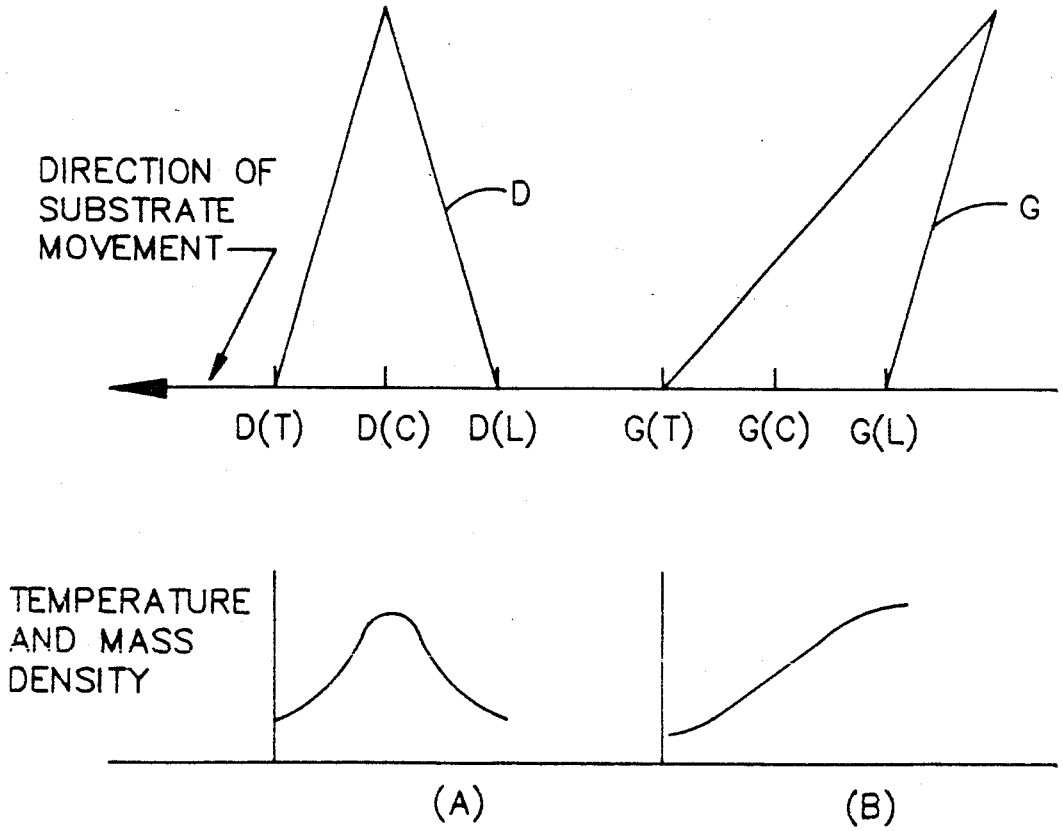
FIG. 3 is a graph comparing the respective temperature distributions across the spray cones produced by the prior art gas-atomizing device and the gas-atomizing devices of the present invention.

The overall result is a generally non-uniform temperature distribution through the cross-section of the deposit E. Particularly, referring to FIG. 3, the bottom portion of the deposit E formed by the leading region D(L) of the pattern D, being adjacent the cool substrate 28 and at a mass density and temperature corresponding to the right end of the graph (A) in FIG. 3, is cooler and lower in density than the intermediate portion of the deposit E formed by the center of the pattern D. The intermediate deposit portion, at a mass density and temperature corresponding to the middle D(C) of the graph (A), is also protected from gas impingement and thus remains hotter and more liquid tending to trap bubbles of gas. On the other hand, the outer portion of the deposit E formed by the trailing region D(T) of the spray portion D is at a mass density and temperature corresponding to the left end D(T) of the graph (A). Like the bottom portion of the deposit E, the outer deposit portion is cooler and less dense than the intermediate portion due to being composed of particles which have traveled further before deposit and which make up the fringe of the spray cone. Also, the outer portion of the deposit E is cooler because it is subject to gas impingement.

To overcome the above problem, the present invention involves modifying the configuration of the prior art gas-atomizing device 20 of FIG. 1 to that of the improved gas-atomizing devices shown in FIGS. 2 and 4–10.

Figure 2:
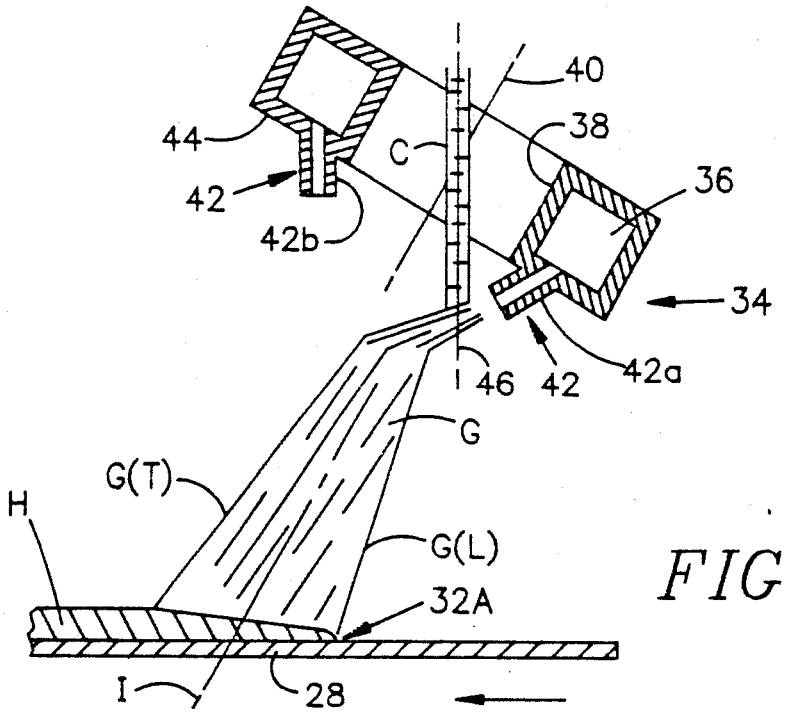
FIG. 2 is a fragmentary schematic elevational view, partly in section, of one modified form of the spray-deposition apparatus employing a gas-atomizing device in accordance with the present invention.

Referring to FIG. 2, one embodiment of a gas-atomizing device constructed in accordance to this invention comprises a circular annulus 34 having an annular plenum chamber 36 therein. The annulus 34 has an annular opening 38 therethrough having an axis 40, coincident with the axis of the annulus 34, and through which the molten stream C passes. Elongated outlets 42 are provided at the bottom of the annulus 34 which communicate with the plenum chamber 36. Each of the outlets 42 has an axis which is inclined inwardly toward the center line 40 of the annular opening 38. It is to be understood that there are a plurality of such outlets 42 on the planar bottom surface 44 of the annulus 34 spaced circumferentially around the axis 40 of the annular opening 38 at equal radial distance from the axis 40. The angle of inclination of the axes of all the elongated outlets 42 with respect to the planar bottom surface 44 of the annulus 34 is the same. The bottom surface 44 is perpendicular to the axis 40 of the annulus 40.

The axis 40 of the annulus 34 is tilted with respect to the vertical axis 46 of the molten stream as shown such that the outlets 42*a* upstream of the molten stream C in respect to the moving substrate 28 are closer to the molten stream C flowing through the annular opening 38 than the outlets 42*b* downstream of the molten stream C. As a result, the atomizing gas exerts higher shear forces on the upstream side of the molten stream C. With this arrangement, the stream C of molten metal is atomized into a spray of molten droplets having a divergent, conical, spray pattern G which has a central axes I inclined with respect to the central axis 46 of the molten stream C in a direction downstream of the deposit receiving area of moving substrate 28. As shown in FIG. 2, the deposit receiving area of the substrate 28 is orientated in a linear horizontal configuration and moves in a direction indicated by the arrow.

With the central axes I of the divergent spray pattern G being inclined with respect to the vertical as shown, the arrangement results in the leading edge or region G(L) of the spray pattern G having less distance to travel to the substrate 28 than the trailing edge G(T). Thus, there is a shorter distance for the hotter particles to reach the substrate 28 during the initial phase of the deposits thereby tending to increase the relative fraction of liquid in the initial deposit. Additionally, with the spray pattern G such that its central axis I is inclined with respect to the vertical, the larger more molten droplets would tend to segregate to the leading edge of the deposit, thereby providing a higher fraction of liquid in the initial deposits.

The spray pattern produced in accordance with the present invention has a temperature (and also a comparable mass density) distribution or profile resembling that of graph (B) of FIG. 3. The temperature and the mass density of the leading edge G(L) of the spray pattern is greater. As a result, the substrate will first receive the desirable spray which provides a higher fraction of liquid in the initial deposits, thus promoting minimal porosity. The temperature and mass density distribution of the gas-atomizing metal particles in the spray cone G will result in an improved, more uniform, distribution of temperature through the cross-section of the deposit H and reduced bottom surface porosity in the deposit.

Other embodiments of a gas atomizer constructed in accordance with the present invention and providing a spray pattern of the type shown in FIG. 2 and having the advantages as discussed in connection therewith are shown in FIGS. 4–10.

Figure 4:
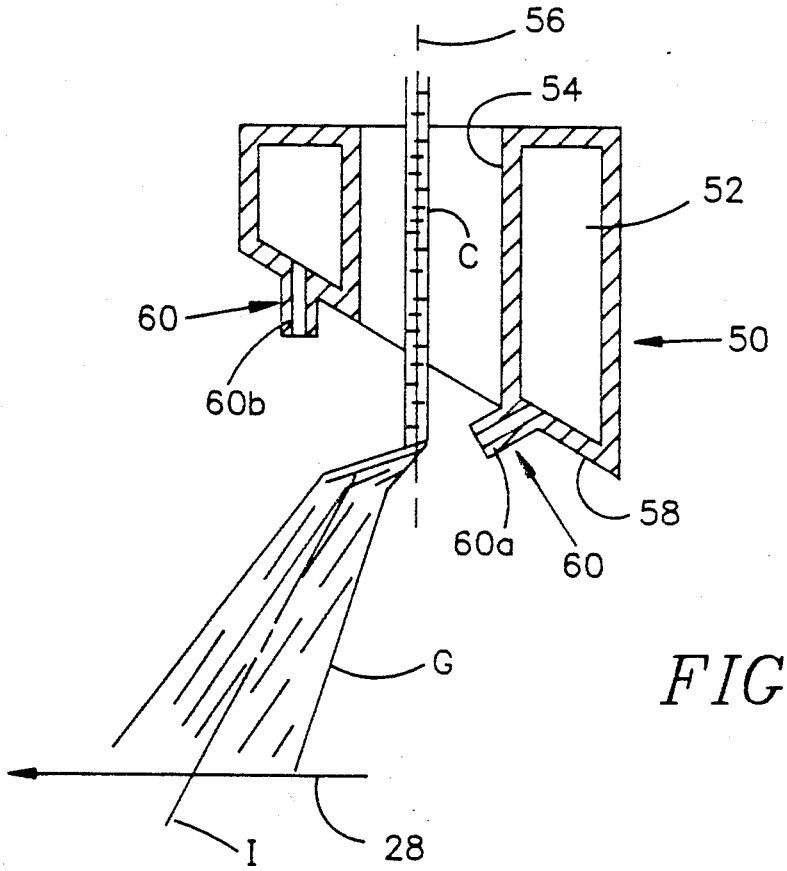
FIGS. 4–6 are fragmentary schematic elevational views, partly in section, of further embodiments of a gas-atomizing device of the present invention.

Referring to FIG. 4, the embodiment shown therein includes an annulus 50 which is generally circular in horizontal cross-section and which contains a plenum chamber 52 which receives the atomizing gas. The annulus 50 is provided with a central annular opening 54 through which the molten stream C passes. The axis 56 of the annular opening 54, which is also the axis of the annulus 50, is coincident with the vertical axis of the molten stream C. As will be noted, the bottom surface of the annulus 50 is tapered defining a planar surface 58 inclined at an angle with respect to the horizontal in a direction extending downwardly toward the upstream portion of the moving substrate 28. The bottom surface 58 of the annulus 50 is provided with elongated outlets 60 extending therefrom and in communication with the plenum chamber 52. Each of the outlets 60 has an axis inclined with respect to the bottom surface 58 in a direction whereby the axes all intersect at a point below the annulus 50. The angles of inclination of the axes of the outlets 60 with respect to the bottom surface 58 of the annulus 50 are equal. There are a plurality of such outlets 60 on the bottom surface spaced around the axis 56.

With the arrangement shown in FIG. 4, the outlets 60*a* on the upstream side of the axis 56 of the molten stream C are closer to, and at a greater angle with respect to, the molten stream C than the outlets 60*b* on the downstream side. This arrangement results in higher shearing forces being applied to the molten stream C on the upstream side. This produces a conical divergent spray pattern G similar to that produced by the device in FIG. 2 in which the central axis I of the spray pattern G is inclined with respect to the vertical axis of the molten stream C in a direction downstream of the moving substrate 28.

Figure 5:
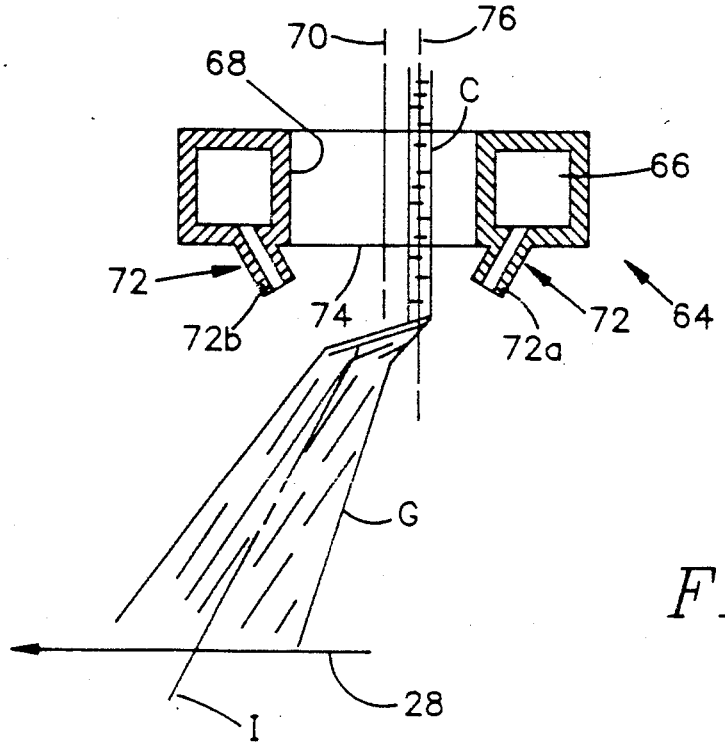

In the embodiment shown in FIG. 5, the gas atomizing device comprises a circular annulus 64 which includes an annular plenum chamber 66 therein for reception of the atomizing gas. A central annular opening 68 having a vertical axis 70, coincident with the axis of the annulus 64, is provided in the annulus 64 through which the molten stream C passess. Elongated outlets 72, which are in communication with the plenum chamber 66, extend from the bottom surface 74 of the annulus 64. Each outlet 72 has an axis extending at an angle inclined with respect to the horizontal bottom surface 74 such that all outlets are pointing downwardly and toward each other. The angle of inclination of the axes of all the outlets 72 with respect to the bottom surface 74 is the same. There are a plurality of outlets 72 on the bottom surface 74 spaced around the axis 70 and equidistant therefrom.

The annulus 64 is positioned such that its axis 70 is offset with respect to the axis 76 of the molten stream C in a horizontal direction downstream of the moving substrate 28. With this arrangement, the upstream outlets 72*a* are closer to the flowing molten stream C than the downstream outlets 72*b*, thus providing higher shear forces against the upstream side of the molten stream C. This produces the divergent spray pattern G as shown having a central axis I inclined with respect to the vertical axis 76 of the molten stream C in a direction downstream of the moving substrate.

Figure 6A:
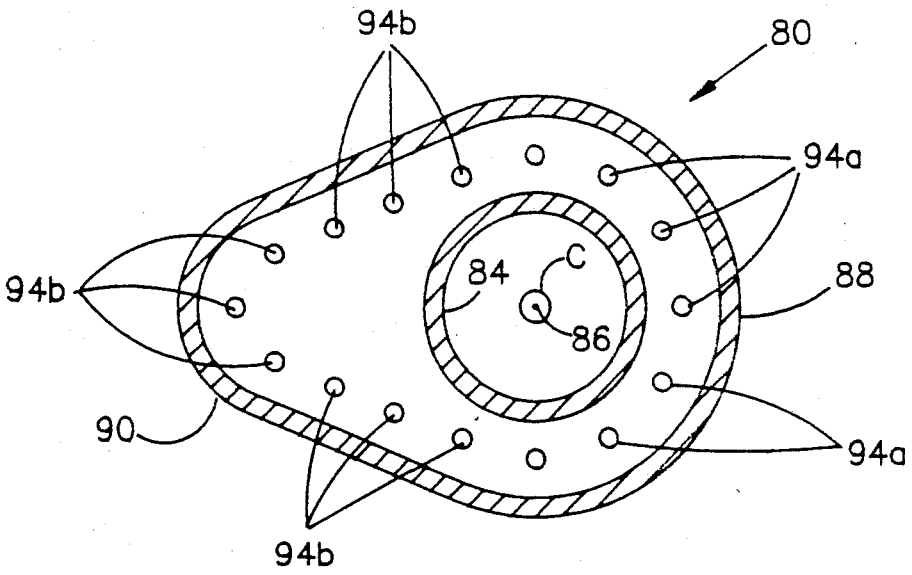
FIG. 6A is a horizontal sectional view of the embodiment shown in FIG. 6 taken along the lines 6A—6A of FIG. 6.
Figure 6:
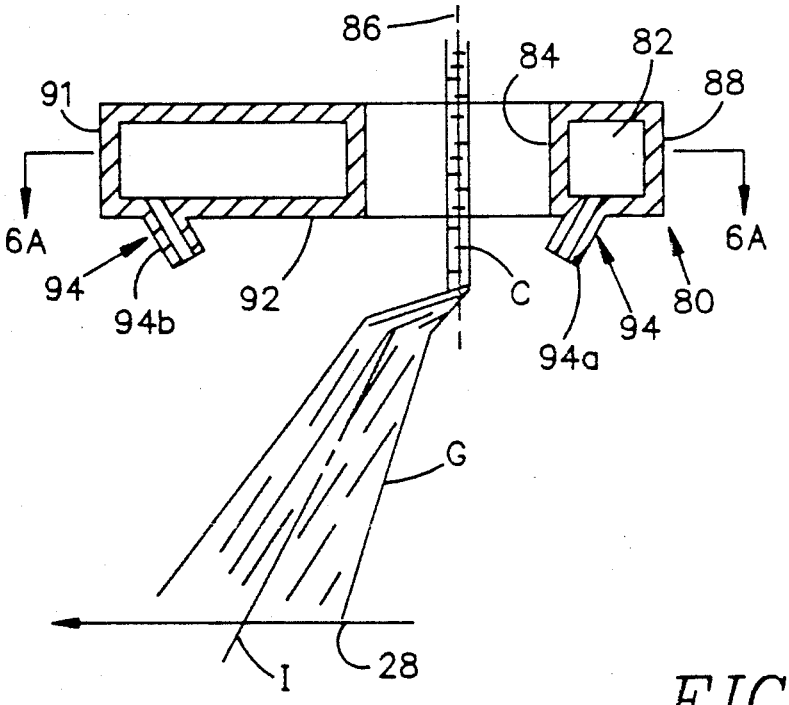

In the embodiment shown in FIGS. 6 and 6A, the gas atomizing device comprises an annulus 80 which is elongated in a horizontal plane in a downstream direction relative to the moving substrate 28. As in the other embodiments, the annulus 80 includes an annular plenum chamber 82 which receives the atomizing gas. The annulus 80 is provided with an annular circular opening 84 through which the molten stream C passes and which has an axis 86 which is coincident with the vertical axis of the molten stream C.

The elongation of the annulus 80 in the horizontal direction is achieved by constructing the portion on the upstream side thereof such that it has an outer side surface 88 forming an arc of a circle in horizontal cross-section. The downstream portion thereof has an outer surface 90 which in a horizontal cross section is generally parabolic.

The bottom surface 92 of the annulus 80 is provided with elongated outlets 94 which are inclined with respect to the bottom surface 92 such that their axes incline downwardly and toward each other at the same angle with respect to the horizontal bottom surface 92. The outlets 94*a* on the upstream side of the axis 86 of the annular opening 84 are arranged in a circular pattern. The outlets 94*b* on the down stream side, which is the downstream side of a plane passing through the axis 86 of the annular opening 84 and extending perpendicular to the direction of movement of the substrate 28, follow the general outline of the parabola and thus, are increasingly further away from the axis 86 of the annular opening 84. With this arrangement, the outlets 94*a* on the upstream side of the annulus 80 are closer to the molten stream C flowing through the annular opening and produce higher shear forces against the molten stream C on the upstream side thereof resulting in the divergent spray pattern G with the inclined central axis I as shown.

Figure 7A:
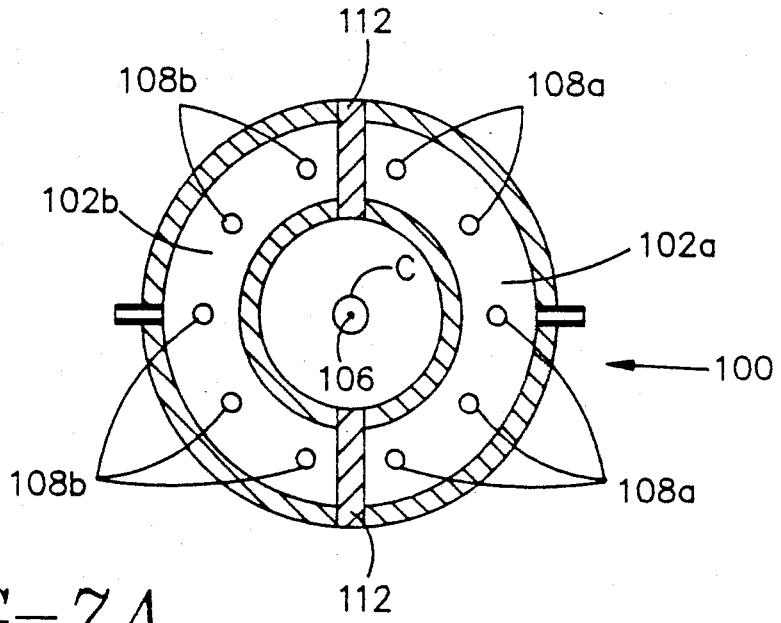
FIG. 7A is a horizontal sectional view of the embodiment of FIG. 7 taken along the lines 7A—7A of FIG. 7.
Figure 7:
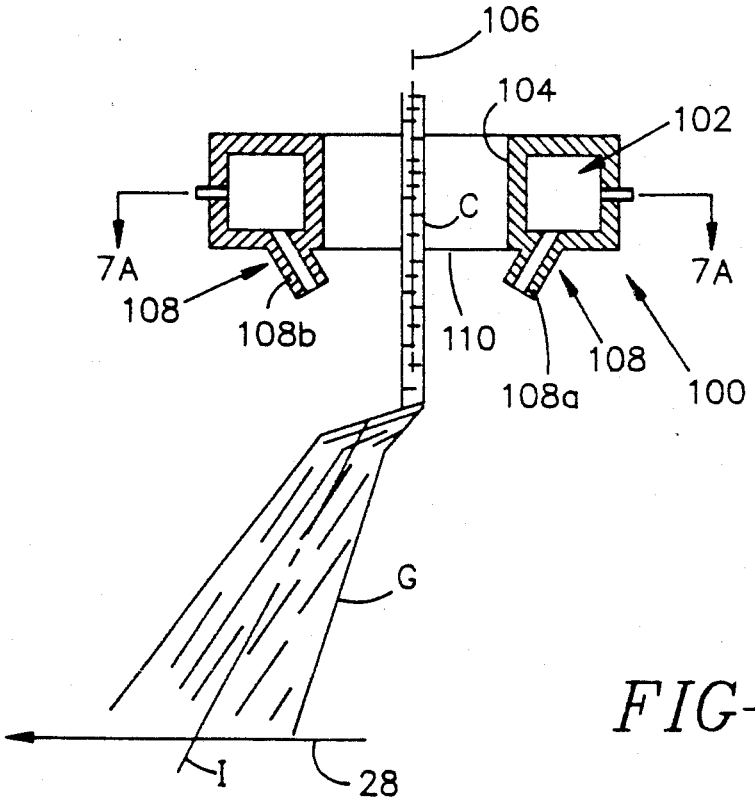
FIG. 7 is a fragmentary schematic elevational view, partly in section, of a further embodiment of a gas-atomizing device of the present invention.

Referring to FIGS. 7 and 7A, the gas atomizing device of this embodiment comprises a circular annulus 100 similar to that shown in FIG. 2. It includes a plenum chamber 102 which receives the atomizing gas. An annular opening 104 through which the molten stream C passes has an axis 106 which, in this case, is coincident with the vertical axis of the molten stream C. A plurality of elongated outlets 108 extend from the bottom surface 110 of the annulus 100 and are in communication with the plenum chamber 102. The outlets 108 are equally spaced around the axis 106 and are radially equidistant therefrom. The outlets 108 each have an axis which inclines at equal angles from the horizontal bottom surface 110 in a direction converging toward each other.

As shown in FIG. 7A, the plenum chamber 102 is divided into two separate sections 102*a* and 102*b* by means of a solid divider 112. The line of division extends in a plane which passes through the axis 106 of the central opening 104 and is perpendicular to the direction of movement of the substrate 28. This arrangement forms a first plenum chamber section 102*a* upstream of the axis 106 in relation to the movement of the substrate 28 and a second plenum chamber section 102*b* downstream of the axis 106 in relation to the first chamber section 102*a*. With this arrangement, relatively high pressure atomizing gas is admitted to the upstream-plenum chamber section 102*a* and relatively low pressure atomizing gas is admitted to the downstream chamber section 102*b*. The high pressure atomizing gas exiting from the outlets 108*a* in communication with the plenum chamber section 102*a* on the upstream side of the annulus 100 will be at a relatively higher pressure than the gas exiting from the downstream outlets 108*b* which are in communication with the low pressure chamber section 102*b*. This will produce a higher shearing force against the upstream side of the molten stream C providing the divergent spray pattern G having an inclined central axis I as shown.

As an alternative to providing high and low pressure gas to the two separate plenum chamber sections 102*a* and 102*b*, the two sections may be separated by a semi-permeable membrane and the atomizing gas admitted only to the upstream chamber section 120*a*. The semi-permeable membrane will permit the gas to flow to the downstream chamber section 102*b*, but such gas will be at a lower pressure. Thus the gas exiting from the upstream outlets 108*a* will be at a higher pressure than the gas exiting from the downstream outlets 108*b* resulting in the same spray pattern G as produced with the dual supply of gas at different pressures.

Figure 8:
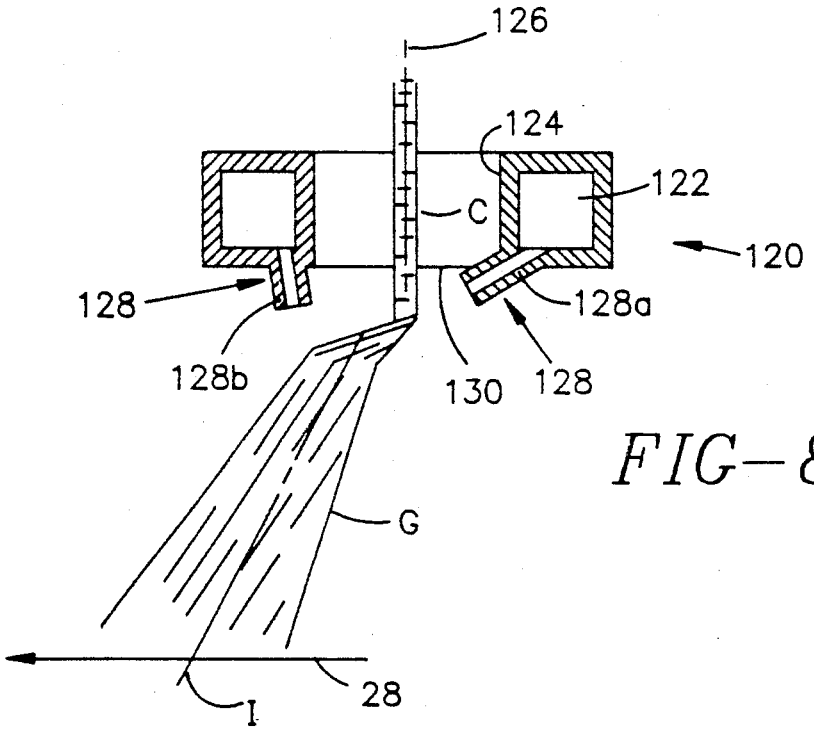
FIG. 8 is a fragmentary schematic elevational view, partly in section, of yet another embodiment of a gas-atomizing device of the present invention.

In the embodiment shown in FIG. 8, the gas atomizing device is an annulus 120, circular in cross-section, and provided with an annular plenum chamber 122. An annular opening 124 extends through the annulus 120 having a vertical axis 126 coincident with the axis of the molten stream C. A plurality of elongated outlets 128 are provided on the horizontal bottom surface 130 of the annulus 120 spaced circumferentially thereon at equidistances from the axis 126. In this embodiment, the axes of the outlets 128*a* on the upstream side of the axis 126 have an angle of inclination with respect to the horizontal bottom surface 130 of the annulus of a lesser degree than the axes of the outlets 128*b* on the downstream side of the axis 126. With this arrangement, the upstream outlets 128*a* direct the atomizing gas to the stream of molten metal before the gas emanating from the downstream outlets and at a sharper angle, providing the spray pattern G as shown having an inclined axis I.

Figure 9:
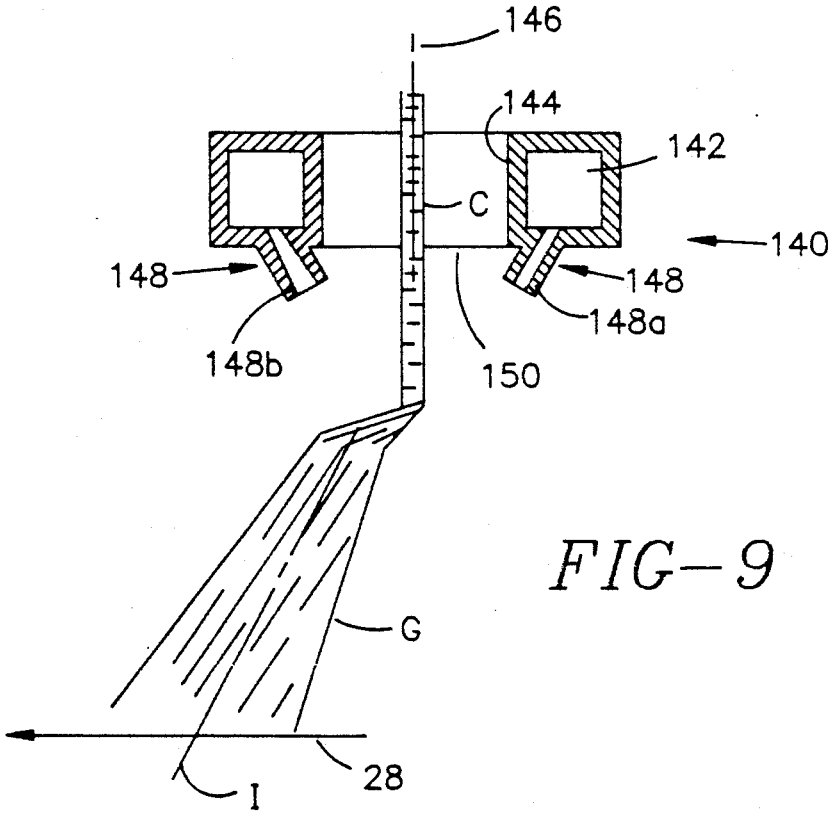
FIG. 9 is a fragmentary schematic elevational view, partly in section, of yet another embodiment of a gas-atomizing device of the present invention.

In the embodiment shown in FIG. 9, the gas atomizing device is an annulus 140 having an annular plenum chamber 142 and a central annular opening 144 therethrough. The annular opening 144 has a vertical axis 146 coincident with the axis of the molten stream C. A plurality of elongated outlets 148 are provided on the horizontal bottom surface 150 of the annulus 140 symetrically spaced around the axis 146 at an equidistance therefrom. The axes of the outlets 148 are inclined at equal angles with respect to the bottom surface 150 so that the axes converge at a point below the annulus 140. In this particular case, the outlets 148*b* on the downstream side of the vertical axis 146 have an opening which diverges outwardly along its axis in an outwardly direction as shown. The upstream outlets 148*a* have openings with a constant or converging diameter which is less than the largest diameter of the openings of the outlets 148*b* in the downstream side. With this arrangement, the pressure of the gas after it exits from the downstream outlets 148*b* will be less than that of the gas exiting from the upstream outlets 148*a* thereby providing the spray pattern G with an inclined central axis I.

Figure 10A:
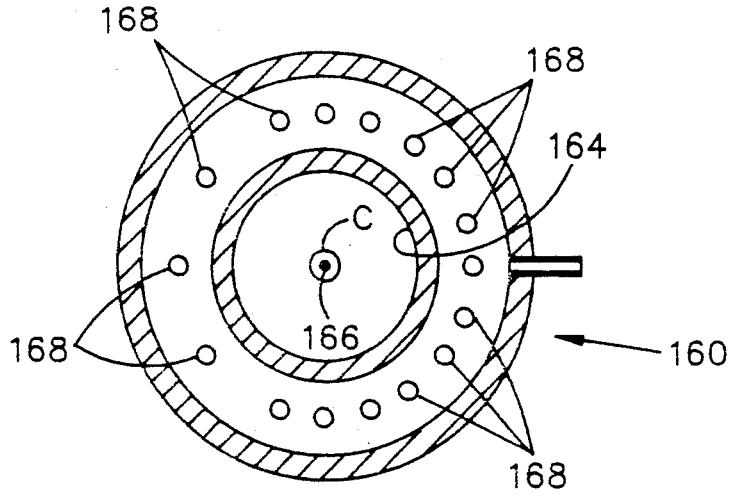
FIG. 10 is a fragmentary schematic elevational view, partly in section, of yet a further embodiment of the present invention.
Figure 10:
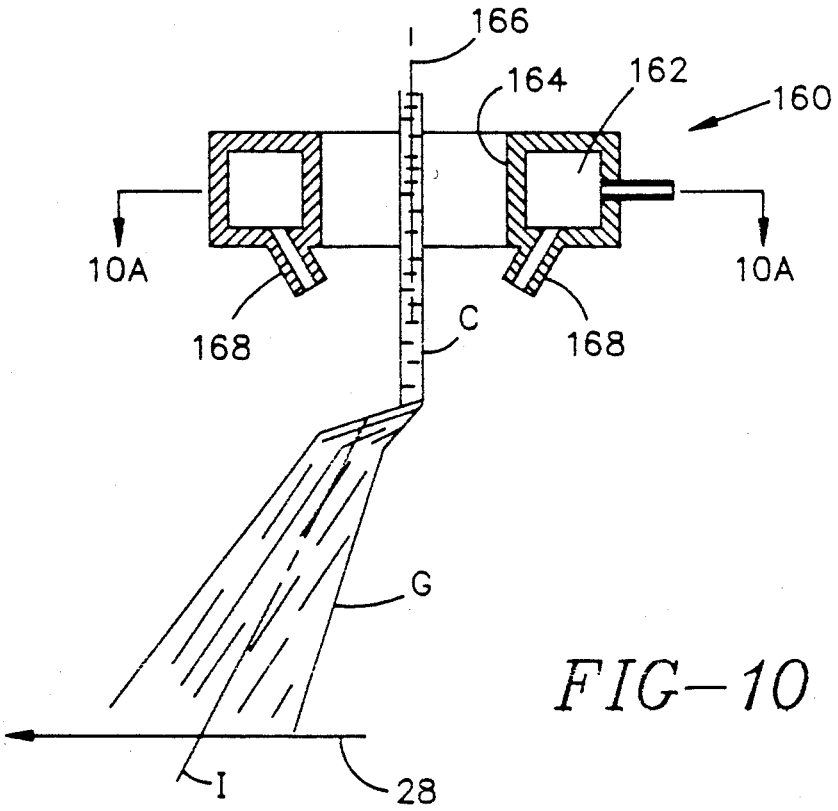

FIGS. 10 and 10A show yet another embodiment in which the gas atomizing device is in the form of a circular annulus 160 provided with an annular plenum chamber 162. An annular opening 164 through which the molten stream C passes is provided in the annulus 160 and has a vertical axis 166 coincident with the vertical axis of the molten stream C. Elongated outlets 168 are provided in the horizontal bottom surface 170 of the annulus 160. The axes of the outlets 168 are inclined at equal angles with respect to the horizontal bottom surface 170 so that they converge below the annulus 160.

In the embodiment shown in FIGS. 10 and 10A, the outlets 168 are circumferentially spaced around the bottom surface at equal radial distances from the axis 166 of the opening 164. In this particular case, there are a greater number of outlets 168 on the upstream side of the axis 166 as compared with the downstream side. This increases the volume of gas acting on the molten stream on the upstream side thereof, which produces the spray pattern G having the inclined central axis I.

Each of the gas-atomizing devices of the present invention produces a divergent spray pattern G whose central axis I projects angularly away from the central axis of the vertical stream in a direction downstream of the moving substrate 28. As a result of gravity, with the gas-atomizing devices of the present invention more molten metal particles will segregate to the bottom, or leading peripheral region G(L), of the spray cone or pattern G, resulting in the higher fraction of liquid in the initial deposits and closer to the substrate than in the center and trailing peripheral regions G(C), G(T) of the spray pattern G and also than with the prior art symmetrical gas-atomizing device 20, as represented by the left end of the graph (B) compared to the center and right end thereof in FIG. 3.

Additionally, the arrangement of the present invention results in the leading edge or upstream region G(L) of the spray pattern G being closer to the substrate 28 than the trailing edge G(T). With this arrangement there is a shorter distance for the hotter particles to reach the substrate 28 during the initial phase of the deposits thereby further increasing the relative fraction of liquid in the initial deposit.

With the configuration of the spray pattern G as set forth herein, the leading, center and trailing portions of the spray pattern are placed one on top of the other on the moving substrate to form, respectively, the bottom, intermediate and upper portions of the deposit H to form the strip. See FIG. 2. The bottom portion of the deposit is disposed closest to, and the upper portion farthest from, the substrate, with the intermediate position therebetween. The higher fraction of particles in the leading edge of the spray and the shortened distance of travel to the upstream portion of the deposit receiving area of the substrate 28 makes more and higher temperature particles available, providing a higher fraction liquid in the inner portion of the deposit H thus promoting minimal porosity.

The U.S. and Foreign patents and applications mentioned in the specification are intended to be incorporated herein by reference in their entirety.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely a preferred exemplary embodiment thereof.

What is claimed:

1. In a molten metal gas-atomizing spray-deposition apparatus, the combination comprising:

(a) means for producing a stream of molten metal;

(b) a gas atomizer for converting said stream of molten metal into a divergent spray pattern, said gas atomizer including an annulus through which said stream of metal flows, said annulus having a plenum chamber therein for receiving pressurized atomizing gas, (c) outlets in said annulus communicating with said plenum chamber and spaced around the stream of molten metal, and (d) a substrate moving in a given direction and having a spray deposit receiving area in a plane substantially perpendicular to the axis of the stream of the molten metal passing through said annulus, the arrangement of said outlets and manifold being such that the central axis of the divergent spray pattern produced by the atomizing gas acting upon the molten stream is inclined with respect to the moving substrate in a direction downstream of the moving substrate.

2. The apparatus of claim 2 wherein the inclination of the central axis of the spray pattern is such that the upstream portion of the spray pattern travels a lesser distance to the substrate than the downstream portion.

3. The apparatus of claim 1 wherein the pressure of the atomizing gas exiting from the outlets positioned upstream of the axis of the molten stream in respect of the moving substrate is higher than the pressure of the gas exiting from the outlets positioned downstream thereof.

4. The apparatus of claim 1 wherein the axes of said outlets positioned upstream of said molten stream in respect to said moving substrate have a greater angle with respect to the axis of the molten stream than the axes of the outlets positioned downstream.

5. The apparatus of claim 1 wherein the exit of said outlets positioned upstream of said molten stream in respect to said moving substrate are closer to said molten stream than the outlets downstream thereof.

6. The apparatus of claim 1 wherein said annulus has a central axis, said outlets being spaced around and at equidistances from said central axis, said axis of said annulus being tilted with respect to the axis of said molten stream such that the upstream portion of the annulus in respect to the moving substrate is positioned closer to said substrate.

7. The apparatus of claim 6 wherein said annulus includes a planar bottom surface perpendicular to said central axis, said outlets being positioned on said bottom surface are having axes equally inclined with respect to said bottom surface.

8. The apparatus of claim 7 wherein said annulus is circular in a cross-section perpendicular to its central axis.

9. The apparatus of claim 1 wherein said annulus has a central axis coincident with the axis of said molten stream, said annulus including a planar bottom surface, said outlets being positioned on said bottom surface, said bottom surface being inclined downwardly with respect to a plane perpendicular to said central axis in a direction upstream of said moving substrate.

10. The apparatus of claim 9 wherein said annulus is circular in a cross section perpendicular to said central axis.

11. The apparatus of claim 1 wherein said annulus has a central axis, said outlets being spaced around and at equidistances from said central axis, said central axis being offset with respect to the axis of said molten stream passing through said annulus in a direction downstream in respect to the moving substrate.

12. The apparatus of claim 11 wherein said annulus includes a planar bottom surface perpendicular to said central axis, said outlets being positioned on said bottom surface and having axes equally inclined with respect to said bottom surface.

13. The apparatus of claim 1 wherein said annulus has an opening therethrough for the passage of said molten stream, said opening having an axis coincident with the axis of said molten stream, said annulus being elongated from said axis of said opening in a direction downstream in respect to said moving substrate.

14. The apparatus of claim 13 wherein said outlets on the downstream side of said opening in respect to said moving substrate are at progressively greater distances from said axis of said opening in a downstream direction than the outlets on the upstream side are from the axis of the central opening.

15. The apparatus of claim 14 wherein said outlets on said upstream side are positioned equidistant from the axis of said opening.

16. The apparatus of claim 14 wherein said annulus includes a planar bottom surface perpendicular to said central axis, said outlets being positioned on said bottom surface and having axes equally inclined with respect to said bottom surface.

17. The apparatus of claim 1 wherein said annulus has a central axis coincident with the axis of said molten metal flowing therethrough, said plenum chamber being divided into two sections, one section being upstream of said central axis in respect to said moving substrate, and the other section being downstream with respect to said central axis, a first set of outlets positioned on said annulus upstream of said central axis and communicating with said one section of said plenum chamber, a second set of outlets on said annulus on the downstream side of said central axis in communication with said other section, and means for admitting a higher pressure atomizing gas to said one section of said plenum chamber than to the other section.

18. The apparatus of claim 17 wherein said annulus includes a planar bottom surface perpendicular to said central axis, said outlets being positioned on said bottom surface and having axes equally inclined with respect to said bottom surface.

19. The apparatus of claim 1 wherein said annulus has a central axis coincident with the axis of said molten metal flowing therethrough, said plenum chamber being divided into two sections by a semipermeable membrane, one section being upstream of said central axis in respect to said moving substrate, and the other section being downstream with respect to said central axis, a first set of outlets positioned on said annulus upstream of said central axis and communicating with said one section of said plenum chamber, a second set of outlets on said annulus on the downstream side of said central axis in communication with said other section, and means for admitting atomizing gas to said one section of said plenum chamber.

20. The apparatus of claim 19 wherein said annulus includes a planar bottom surface perpendicular to said central axis, said outlets being positioned on said bottom surface and having axes equally inclined with respect to said bottom surface.

21. The apparatus of claim 1 wherein said annulus has a central axis coincident with the axis of said molten stream passing therethrough and a planar bottom surface perpendicular to said central axis, said outlets being positioned on said bottom surface and each having an axis, the axes of said outlets positioned upstream of said molten stream in respect to said moving substrate having a greater angle with respect to said axis of said molten metal than the axes of said outlets positioned downstream.

22. The apparatus of claim 1 wherein said annulus has a central axis coincident with the axis of said molten stream passing therethrough, said outlets being spaced around and at equidistances from said central axis, the openings of said outlets on the downstream side of said central axis in respect to said substrate having elongated openings diverging outwardly along their axes in an outward direction, the outlets on the upstream side having a diameter less than the largest diameter of the openings in the outlets on the downstream side whereby the gas exiting from said outlets with the larger openings is at a lower pressure than the gas exiting from the other outlets.

23. The apparatus of claim 22 wherein said annulus includes a planar bottom surface perpendicular to said central axis, said outlets being positioned on said bottom surface and having axes equally inclined with respect to said bottom surface.

24. The apparatus of claim 1 wherein said annulus has a central axis coincident with the axis of said molten metal passing therethrough, said annulus having a greater number of outlets on the upstream side of the central axis in respect to the moving substrate as on the downstream side.

25. The apparatus of claim 24 wherein said outlets are spaced equidistant from said central axis.

26. The apparatus of claim 25 wherein said annulus includes a planar bottom surface perpendicular to said central axis, said outlets being positioned on said bottom surface and having axes equally inclined with respect to said bottom surface.

* * * * *

UNITED STATES PATENT AND TRADEMARK OFFICE

CERTIFICATE OF CORRECTION

PATENT NO. : 4,901,784

DATED : February 20, 1990

INVENTOR(S) : Sankaranarayanan Ashok and Harvey P. Cheskis

It is certified that error appears in the above—identified patent and that said Letters Patent is hereby corrected as shown below:

Column 10, Claim 7, line 45, after "surface", delete "are" and insert --and--.

Signed and Sealed this

Seventeenth Day of March, 1992

*Attest:*

*Attesting Officer*

HARRY F. MANBECK, JR.

*Commissioner of Patents and Trademarks*